United States Patent [19]

Sallman

[11] 4,191,525

[45] Mar. 4, 1980

[54] ASPIRATION CIRCULATION SYSTEM AND METHOD

[75] Inventor: Charles M. Sallman, Valparaiso, Ind.

[73] Assignee: N L Industries, Inc., New York, N.Y.

[21] Appl. No.: 891,770

[22] Filed: Mar. 30, 1978

[51] Int. Cl.[2] ..... F26D 7/04; F27B 3/22

[52] U.S. Cl. ..... 432/21; 432/25; 432/26; 432/198; 432/199; 432/203

[58] Field of Search ..... 432/19, 21, 198, 199, 432/203, 25, 26; 431/9, 115, 116; 417/155

[56] References Cited

U.S. PATENT DOCUMENTS

| | | | |
|---|---|---|---|
| 1,363,188 | 12/1920 | Muckle | 432/21 |
| 1,399,070 | 12/1921 | Munhollon | 432/21 |
| 2,085,811 | 7/1937 | Loftus | 432/21 |
| 2,504,320 | 4/1950 | Gamble | 431/21 |
| 2,849,221 | 8/1958 | Cone et al. | 432/21 |
| 3,078,914 | 2/1963 | Bigelow, Jr. | 431/115 |
| 3,445,098 | 5/1969 | Kaether | 432/21 |

*Primary Examiner*—John J. Camby
*Attorney, Agent, or Firm*—Gerald K. White

[57] ABSTRACT

An improved atmosphere circulation system involving the use of aspirators for inducing turbulence of pressurized atmosphere within a vessel promotes temperature uniformity within the vessel and, for a given degree of temperature uniformity, reduces energy consumption.

8 Claims, 1 Drawing Figure

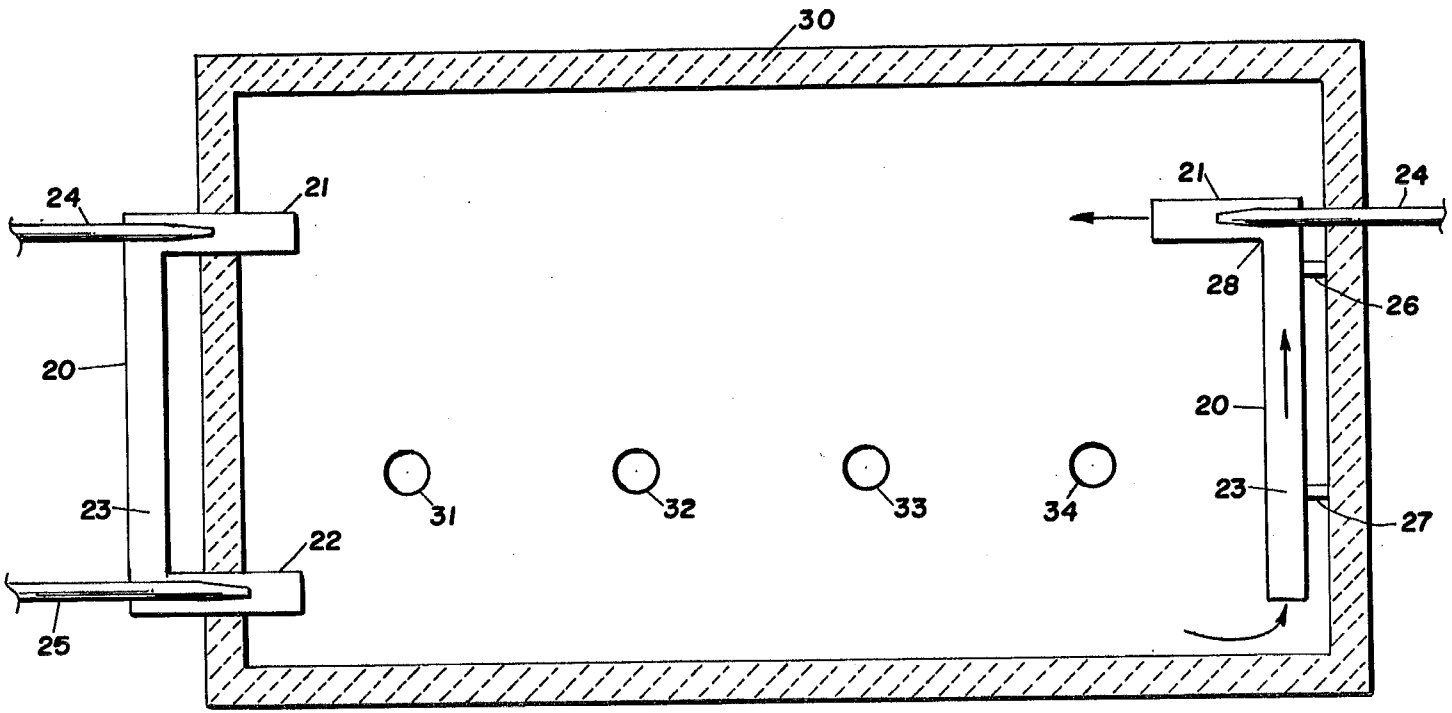
24
26
27
21
28
20
23
34
33
30
32
31
21
22
24
20
23
25

ASPIRATION CIRCULATION SYSTEM AND METHOD

The invention relates to a system and method for improving temperature uniformity of an enclosed atmosphere by recirculation of the atmosphere through a system involving a recirculation passageway. Typically, the inventive system is suitable for use in combination with furnaces, driers, kilns, refrigerators, and the like. In the past, atmosphere circulation in large industrial heating furnaces has been accomplished with use of cumbersome and expensive fan systems that require relatively large amounts of energy to operate. On the other hand, the system of the invention utilizes an aspirator to cause sufficient atmosphere circulation to improve temperature uniformity within the enclosure or vessel. Considerable energy savings are obtained in this manner.

An aspirator is a device to facilitate fluid flow which is activated by passing a compressed fluid through an expansion orifice to create a high velocity fluid which induces flow of the atmosphere in the immediate area of the high velocity fluid. In the context of the invention, an aspirating device is utilized to mix atmosphere gases with a high velocity fluid with the resultant creation of a penetrating mixture capable of stirring contained atmospheres and thus promote uniform temperatures within the vessel.

Recirculation of heating gases or atmospheres through use of pressurized aspirating jets is known in the art and illustrated in U.S. Pat. Nos. 1,363,188; 1,399,070; 2,085,811; 2,504,320; 2,849,221; and 3,445,098. None of these devices or systems disclose the improved and advantageous compact, easily retrofitted system of the invention involving the use of a tube-like recirculation passageway or the ability to reverse flow through the aspiration system. Such advantages are considered to be important from the standpoint of economically adapting an existing furnace or the like to the aspiration system of the invention and thereby obtaining improved performance.

The system of the invention involves the use of an aspiration device in combination with an atmosphere containing vessel. The aspiration device serves to circulate the atmosphere by drawing or entraining atmosphere into a portion of the device and expelling atmosphere from a different portion. The drawing or aspirating action is caused by the introduction pressurized fluid into the device near the exit point. Mixing of the fluid and drawn atmosphere at the point of fluid introduction results in the creation of a penetrating mixture capable of stirring the atmosphere to the extent that uniform temperatures and constant pressures are obtained.

It is an objective of the invention to provide a method and system of vessel atmosphere circulation that is efficient in terms of promoting temperature uniformity. It is an additional objective to provide an invention that is simpler and less expensive than the prior art aspirating and fan circulation systems. It is a yet further objective to provide a circulation procedure that will result in the use significantly less amounts of energy than the systems of the prior art. These and additional objectives and advantages will be apparent to those skilled in the art from the following description of the invention.

The sole FIGURE is an elevation view of the system of the invention in which several embodiments of the use of an aspirator in combination with a refractory lined heating furnace are illustrated.

The aspiration device of the invention, as shown in the left portion of the Figure, includes tube-like shaped atmosphere circulation member 20 which comprises open end members 21 and 22 which are interconnected with each other by closed tube-like atmosphere recirculation passageway member 23 so as to form a "U" shaped open-ended tube. Aspiration actuating tubes 24 and 25 extend into circulation member 20 proximate to the interconnection joint between open end members 21 and 22 and passageway member 23 to a point beyond the interconnection and into the respective open end members. Actuating tubes 24 and 25 have an expansion orifice to impart increased fluid velocity. The tubes introduce a high velocity fluid in a direction generally parallel to the longitudinal axis of the particular open end member from which the recirculated atmosphere exits to cause vessel atmosphere to be drawn or aspirated into an open-ended member, pass through the closed tube-like atmosphere passageway member and substantially perpendicular connection, and finally exit as a mixture with the apiration fluid back into the vessel from the other open ended exit member.

The exit or orificed end of actuating tubes 24 and 25 should extend beyond the interconnection of members 23 and 21 or 22 and into member 21 and 22 so as to ensure the creation of good aspirating action. Actuating tubes 24 and 25 are connected to a suitable source of pressurized fluid such as a compressor or the like. Such sources are conventional and, accordingly, are not illustrated in the Figure.

The Figure is also useful for illustrating several embodiments of the system. First of all, the aspiration device depicted at the right hand portion of the Figure indicates the use of a single device having one actuating tube and no open ended entry member such as that shown on the left hand portion of the drawing. Such device is contained within refractory-lined furnace 30 and supported in position with support members 26 and 27. Heating for the furnace is provided by burners 31–34. The aspiration device depicted at the left hand portion of the Figure illustrates the use of two actuating tubes and the preferred embodiment of positioning the device partially outside of the furnace vessel. Such location provides for easier maintenance, inspection, and installation of the device. Actuating tubes 24 and 25 are operated at separate times so as to have the capability of reversing the flow of atmosphere through the atmosphere circulation member. This procedure leads to greater temperature uniformity through reduced stratification than if only single directional flow is utilized. Hence, this procedure is preferred when critically narrow treating temperature ranges are required. Another desirable characteristic of the system is that it may be easily retrofitted with existing vessel structures due to the relatively small space requirements of the restricted recirculation path of the device and the essentially compact nature of the device.

The Figure also illustrates that a plurality of aspiration devices may be used for a given vessel. The devices may also be placed at a variety of positions and angles so as to achieve any desired atmosphere circulation pattern.

The method of the invention generally comprises introducing an aspirating fluid at a pressure from about 1 to 600 p.s.i.g. into a first passageway that is in open relationship with the interior of an atmosphere containing vessel to cause atmosphere to be drawn from an interior location into a passageway that is open to the interior, pass through a closed interior passageway, and then pass into a separate passageway where the drawn atmosphere mixes with the aspirating fluid, and then exits from this passageway back into the vessel at a location different from the entry passageway. An aspiration pressure of 1 p.s.i.g. is required to ensure that the device is operational and the 600 p.s.i.g. limit represents a practical operating maximum for most actuating tube materials. It is presently preferred to use an aspirating pressure of about 15 to 100 p.s.i.g. for most operational conditions because the required quantity of flow and resistance can be controlled between these limits. Following the establishment of atmosphere recirculation for a suitable length of time, the introduction of fluid is stopped and then fluid is introduced in a separate passageway to cause reverse flow through the system. This procedure enhances temperature uniformity and thus constitutes a preferred method of operation. Inasmuch as the system and process of the invention are suitable for use in a wide variety of applications, it follows that a wide variety of inert, reducing, or oxidizing aspirating fluids and atmospheres are within the scope of the invention. For example, any of the various commonly used metallurigical exothermic, endothermic, or inert atmospheres can be employed as both the fluid and atmosphere so as to maintain the needed uniformity and function of the atmosphere. On the other hand, it is also contemplated that an aspirating fluid having a composition different than that of the recirculated atmosphere could be employed where it is advantageous or not detrimental to change the composition of the atmosphere. One such application involves the introduction of any well known fluid carburizing agent such as a hydrocarbon when it is desired to raise the surface carbon content of steel parts. Air and steam also constitute suitable, readily available and economically attractive aspirating fluids.

The following comparative examples demonstrate some of the benefits and advantages of the invention.

EXAMPLE 1

A gas-fired furnace without the aspirating device of the invention was brought to 800° F. and loaded with a 14,620 pound steel test piece. A treatment time of 10 hours was used. 14,770 CF of natural gas @ 32 p.s.i.g. was required to maintain the 800° F. furnace temperature.

EXAMPLE 2

The same gas-fired furnace as that of Example 1 was equipped with the aspirating device of the invention and brought to 800° F. and loaded with a 14,620 pound steel test piece. A treatment time of 10 hours was used. 11,580 CF of natural gas @ 32 p.s.i.g. was needed to maintain the 800° F. furnace temperature. Thus with the same critical temperature criteria, a fuel reduction of 1,190 CF of natural gas @ 32 p.s.i.g. was obtained. This represents a 21.6% total fuel reduction and demonstrates the effective nature of the inventive system and method.

I claim:

1. A system for promoting temperature uniformity in a vessel having means for effecting temperature changes within said vessel and closure means for containing an atmosphere within an interior location of said vessel comprising a vessel atmosphere aspiration device in operative relationship with said vessel: said aspiration device comprising a tube-like shaped atmosphere circulation member having an open ended atmosphere exit member and an open ended atmosphere entry member, said exit and entry members being interconnected by a tube-like atmosphere recirculation passageway member with said exit member and said atmosphere passageway member being interconnected approximately perpendicular to each other; aspiration actuating means extending into said atmosphere circulation member proximate to said perpendicular interconnection and directed toward said vessel interior to a point beyond said perpendicular interconnection and into said exit member for passing an aspirating fluid into said exit member and thereby causing said vessel atmosphere to be aspirated through said atmosphere circulation member; and fluid introduction means connected to said aspiration actuating means for introducing a pressurized fluid into said aspiration actuating means; said aspiration device being operationally positioned with said vessel so that said open ended exit member and said open ended entry member extend through said closure means into an interior location of said vessel and said atmosphere passageway member is at a location that is exterior of said vessel closure means, whereby said vessel atmosphere may enter said open ended entry member, pass through said atmosphere passageway member and into said exit member, and exit back into the vessel through said exit member and thereby promote temperature uniformity within said vessel interior.

2. The system of claim 1, wherein: more than one aspiration device is in operative relationship with said vessel.

3. The system of claim 1, wherein: an open ended entry member and said atmosphere recirculation passageway member are interconnected approximately perpendicular to each other and further including a second aspiration actuating means extending into said atmosphere circulation member proximate to said perpendicular interconnection of said entry member and said recirculation member and directed toward said furnace interior to a point beyond said interconnection and into said open ended entry member for passing an aspirating fluid into said open ended entry member and thereby causing said vessel atmosphere to be aspirated through said atmosphere circulation member; and fluid introduction means connected to said second aspiration actuating means for introducing a pressurized fluid into said second aspiration actuating means.

4. A method for promoting temperature uniformity in a substantially closed atmosphere containing vessel that is in operative relationship with a vessel atmosphere aspiration device, said device comprising a tube-like shaped atmosphere circulation member having a first open ended atmosphere passage member and a second open ended atmosphere passage member, said first and second members being interconnected by a tube-like atmosphere recirculation passageway member with said first and second members and said atmosphere passageway member being interconnected approximately perpendicular to each other; first and second aspiration actuating means extending into said atmosphere circulation member proximate to said perpendicular interconnections and directed toward said vessel interior to a point beyond said interconnections and into said first and second members for passing an aspirating fluid into said exit member; and fluid introduction means connected to said first and second aspiration actuating means for introducing a pressurized fluid into said first and second aspiration actuating means; said method comprising: introducing an aspirating fluid from said first aspiration actuating means at a pressure of from 1 to 600 psig into said first passage member to cause said vessel atmosphere to be drawn from an interior area of said vessel into said second passage member, pass through said atmosphere recirculation passageway member and than pass into said first passage member where said drawn atmosphere and said aspirating fluid are mixed and then returned to said vessel interior through said first passage member; ceasing the introduction of aspirating fluid into said first passage member; and then introducing an aspirating fluid from said second aspiration actuation means into said second passage member to cause said vessel atmosphere to be drawn into said first passage member and to return into said vessel from said second passage member.

5. The method of claim 4, wherein: said aspiration fluids and said vessel atmosphere are substantially the same general composition.

6. The method of claim 4, which further includes: said aspirating fluids and said vessel atmosphere are of different composition whereby said vessel composition is changed during the process.

7. The method of claim 4, which further includes: altering the composition of said aspirating fluids during the process.

8. The method of claim 4, wherein: said aspirating fluids are introduced at a pressure of from about 15 to 100 psig.

* * * * *